US005469974A

United States Patent [19]

Hagan

[11] Patent Number: 5,469,974

[45] Date of Patent: Nov. 28, 1995

[54] METHOD AND APPARATUS FOR SELECTIVELY DIRECTING WORK OBJECTS

[75] Inventor: James C. Hagan, Stockton, Calif.

[73] Assignee: Hagan Electronics International, Stockton, Calif.

[21] Appl. No.: 154,606

[22] Filed: Nov. 18, 1993

Related U.S. Application Data

[63] Continuation of Ser. No. 665,479, Mar. 6, 1991, abandoned.

[51] Int. Cl.[6] ..... B07C 9/00

[52] U.S. Cl. ..... 209/652; 209/925

[58] Field of Search ..... 209/651–654, 209/925; 198/370, 372

[56] References Cited

U.S. PATENT DOCUMENTS

| | | | |
|---|---|---|---|
| 3,730,325 | 5/1973 | Goodwin | 209/652 X |
| 3,944,047 | 3/1976 | Mumma | 198/372 |
| 4,142,636 | 3/1979 | Planke | 209/657 X |
| 4,249,661 | 2/1981 | Lem | 198/372 X |
| 4,549,662 | 10/1985 | Schoenig, Jr. et al. | 209/654 X |
| 4,655,350 | 4/1987 | Mojden et al. | 209/652 X |
| 4,765,488 | 8/1988 | Moriarity | 209/925 X |

FOREIGN PATENT DOCUMENTS

| | | |
|---|---|---|
| 2620053 | 3/1989 | France . |
| 2620054 | 3/1989 | France . |

*Primary Examiner*—David H. Bollinger
*Attorney, Agent, or Firm*—Worrel & Worrel

[57] ABSTRACT

A method and apparatus for selectively directing work objects wherein the work objects are passed along a path of travel, predetermined characteristics of the work objects are sensed and work objects having the predetermined characteristics are diverted from the path of travel successively to alternate sides of the path of travel without movement in a return direction intermediate diversion of successive work objects.

3 Claims, 2 Drawing Sheets

METHOD AND APPARATUS FOR SELECTIVELY DIRECTING WORK OBJECTS

This is a continuation of application Ser. No. 07/665,479 filed on Mar. 6, 1991, now abandoned.

BACKGROUND OF THE INVENTION

1. Field of the Invention

The present invention relates to a method and apparatus for selectively directing work objects and, more particularly, to such a method and apparatus which are operable so as to permit randomly ordered work objects to be selected during transport along a path of travel by the application of motion to the work objects so selected with an efficiency, dependability and a substantially lower risk of damage to the work objects than has heretofore been achieved in the art.

2. Description of the Prior Art

The handling, processing, packing and shipping of fungible goods characteristically requires selection from among randomly ordered goods so as to combine goods having common characteristics of a predetermined type. For example, in the handling of fresh fruits and vegetables, sorting of the goods as to such characteristics as weight, size, color, shape, maturity and the like is inherent in the process. A multiplicity of conventional methods and apparatuses have been employed in such operations and they have been developed to the point of a relatively high degree of reliability. For example, the applicant's U.S. Pat. No. 4,549,272 is directed to an article sizing apparatus for measuring the volume, weight or shape of articles, such as fresh vegetables and the like, and thereafter loading containers with the articles so selected.

Characteristically, such sorting or selecting is achieved by transporting the work objects along a path of travel, such as a conveyor system, in randomly ordered, single file subsequent to receipt of the work objects in bulk, such as in bins after harvest. During transport along the conveyor system, the work objects are subjected to any of a wide assortment of detecting or sensing apparatuses operable to determine the predetermined characteristics of each work object. Thereafter a mechanism operably connected to the sensing system is activated to displace each work object so selected in accordance with the predetermined characteristics from the conveyor system for collection with other work objects having substantially the same predetermined characteristics. In conventional practice, all such mechanisms for displacing the work objects from the path of travel require movement of a work object engaging member substantially transversely of the conveyor system to displace the work object and, subsequently, return of the work object engaging member to a start position. Such conventional mechanisms suffer from a host of problems intrinsic to the operation. Heretofore, these problems have been considered an essential, but unfortunate, result of such sorting operations.

The specific problems incident to the sorting operation are dependant, in part, upon the specific methods and apparatuses employed in the sorting process. However, certain of the problems are largely common to all such conventional practices. Thus, for example, since the work object engaging member must always return to a start position before it can be employed to displace the next successive work object from the conveyor system, movement of the work object engaging member must be at a very high velocity. While such velocities are well within the capabilities of modern technology, the perishable nature of the work objects, such as fresh fruits and vegetables, results in the work objects frequently being damaged by the application of such force thereto. In the case of fresh fruits and vegetables, this damage includes bruising and otherwise marring the work objects to a degree frequently diminishing the value of the work objects in the marketplace. Since such damage typically does not become evident for many days, it normally is not possible to select and discard the damaged work objects before they are shipped to market. This damages the market for the goods.

Similarly, because of the application of such force at high velocity, the work objects themselves are accelerated to velocities which cause them subsequently to engage other surfaces with such force as to cause similar damage. Even at such high velocities the work object engaging members must be returned across the conveyor to a start position. Since successive work objects traveled along the conveyor system frequently may also have the same predetermined characteristics requiring that they be displaced from the conveyor system, it is typically necessary to space the work objects along the conveyor system so as to allow time and space for return of the work object engaging member to the start position sufficiently soon to be able to displace the next successive work object from the conveyor system if so selected.

The equipment necessary to achieve such spacing of the work objects is not entirely dependable. Furthermore, because of the spheroid configurations of such goods as fruits and vegetables, the work objects frequently roll toward each other during transport or the conveyor system. Thus, the operative effect of the initial spacing is defeated. The work object engaging member thus is rendered ineffectual in that it fails to displace many of the work objects sensed by the sensing mechanism. The engaging member impacts many of the work objects during return to the start position thereby damaging the work objects, knocking certain other of the work objects from the machine and allowing still others to pass from the machine without the desired selection having taken place.

A still further problem chronic to most such conventional methods and apparatuses is the wearing and break down of the mechanisms operable to achieve such high velocity movement of the work object engaging member. Not only is such trauma incident to the high velocities achieved, but the trauma of reciprocal movement at high velocity is additionally severe.

Therefore, it has long been known that it would be desirable to have a method and apparatus which are operable to achieve the precise and dependable displacement of work objects in accordance with predetermined characteristics efficiently, dependably and without the multitude of problems associated with conventional methods and apparatuses.

SUMMARY OF THE INVENTION

Therefore, it is an object of the present invention to provide an improved method and apparatus for selectively directing work objects.

Another object is to provide such a method and apparatus which are operable to permit the selection of work objects having predetermined characteristics from a stream of randomly ordered work objects of disparate characteristics efficiently, dependably and substantially without risk of damage thereto.

Another object is to provide such a method and apparatus which permit work objects to be selected from a continuous stream of randomly ordered work objects without requiring substantial spacing between adjacent work objects in the stream.

Another object is to provide such a method and apparatus which permit work objects to be selectively diverted from a continuous stream of the work objects by the application of force in a single direction transversely of the path of travel of the stream and without having to have motion in the opposite direction to return the diverting member to a start position before again being capable of diverting a successive work object frown the path of travel.

Another object is to provide such a method and apparatus which are particularly well suited to the sorting of work objects such as fresh fruits and vegetables of a perishable nature and subject to damage such as bruising, marring and the like.

Another object is to provide such a method and apparatus which have application to virtually any operative environment in which it is desired to segregate one or more work objects frown a multiplicity of such work objects and wherein the member employed to displace the selected work object from the multiplicity of work objects is immediately available for displacement of a second work object after displacement of the first work object.

Another object is to provide such a method and apparatus which substantially reduce the wear and break down associated with conventional methods and apparatuses employed in the sorting of fungible goods.

Another object is to provide such a method and apparatus which are fully compatible with other methods and apparatuses employed in the handling of work objects.

Further objects and advantages are to provide improved elements and arrangements thereof in an apparatus for the purpose described which is dependable, economical, durable and fully effective in accomplishing its intended purpose.

DESCRIPTION OF THE PREFERRED EMBODIMENT

Figure 1:
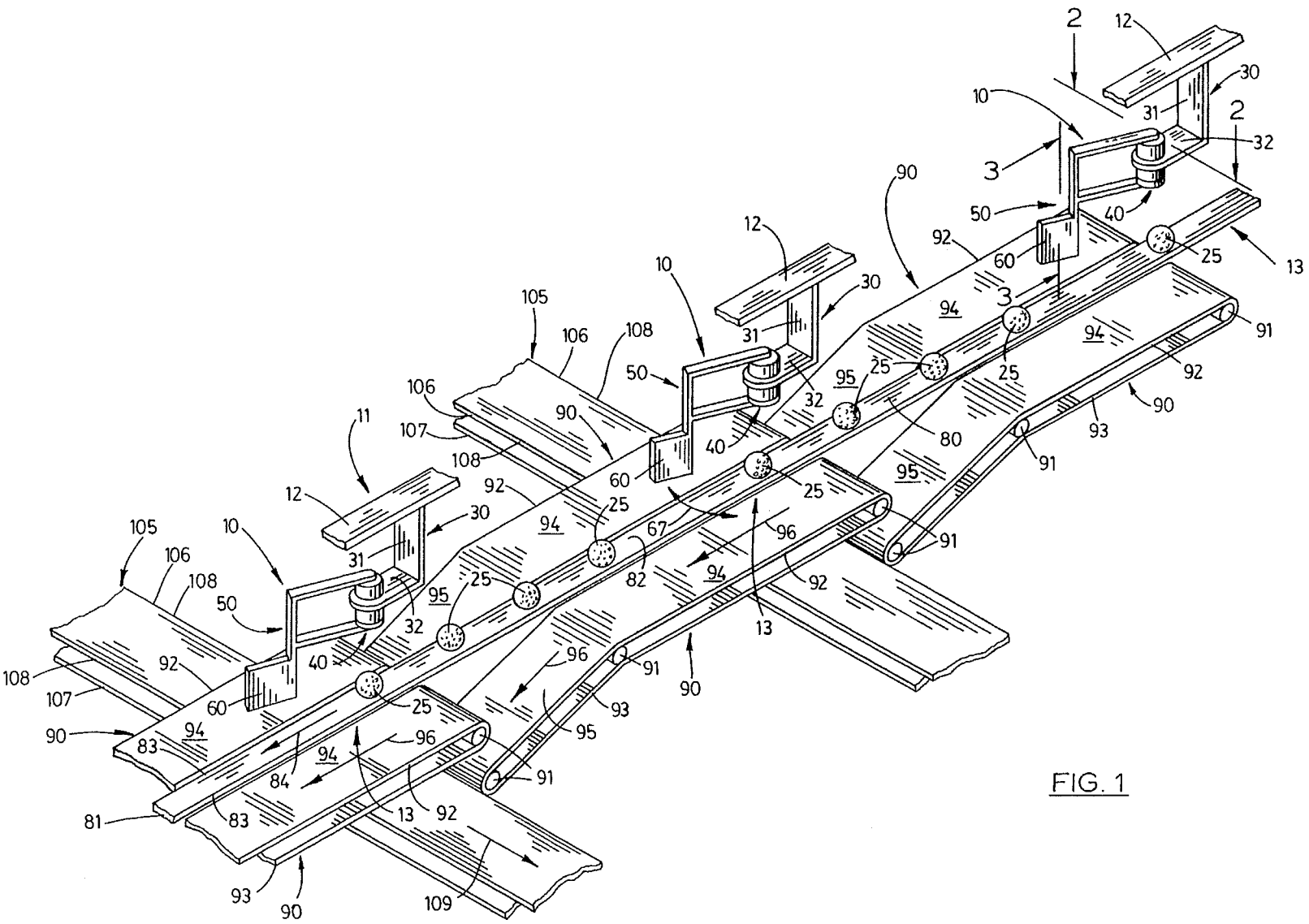
FIG. 1 is a fragmentary perspective view of the apparatus of the present invention employed in the practice of the method of the present invention.

Referring more particularly to the drawings, the apparatus for selectively directing work objects of the present invention employed in the method for selectively directing work objects of the present invention is generally indicated by the numeral 10 in FIG. 1. As shown therein, a work object sorting machine is generally indicated at 11. The sorting machine includes a frame 12 and three work stations 13. It will be understood that, except as hereinafter to be described, the work object sorting machine 11 is entirely conventional and is illustrative of the type of sorting machine heretofore known in the art. The apparatus of the applicant's U.S. Pat. No. 4,549,272 is herein incorporated by reference for purposes of illustrating a structure of one such sorting machine. However, it will be understood that the method and apparatus of the present invention are not in any way limited to usage either in the apparatus of U.S. Pat. No. 4,549,272 or to use in or with any other apparatus. Reference to U.S. Pat. No. 4,549,272 is provided only for the purposes of illustrating how such apparatuses operate and as background for the method and apparatus of the present invention.

As will hereinafter become more clearly apparent, the method and apparatus of the present invention are adapted for use in selectively directing virtually any work objects, but are particularly well suited to directing work objects such as fresh fruits and vegetables. For illustrative convenience, a plurality of work objects 25 are shown in the drawings, representing oranges, having spherical outer surfaces 26.

The apparatus 10 of the present invention has a solenoid mount 30 affixed on the frame 12 of the machine 11 in each work station 13. Each solenoid mount has a vertical portion 31, mounted on the frame 12, on which is mounted a horizontal portion 32 disposed at substantially right angles relative thereto.

A double acting solenoid 40 is mounted on the horizontal portion 32 of each solenoid mount 30. The double acting solenoid is preferably, although not necessarily, a solenoid manufactured by Lucas Ledex Inc. of Vandalia, Ohio, known as a "Bi directional 75". The double acting solenoid has an upper section 41, which extends above the horizontal portion of the solenoid mount, and a lower section 43 extending beneath the horizontal portion 32. The upper and lower sections of the double acting solenoid are aligned along an axis of rotation 45 substantially normal to the horizontal portion 32 of the solenoid mount. The double acting solenoid has a single drive shaft 46 extending therethrough along the axis of rotation 45. The drive shaft has an upper portion 47, extending endwardly from the upper section 41, and an opposite lower portion, extending endwardly from the lower section 43. The double acting solenoid is operable to rotate the drive shaft in both clockwise and counterclockwise directions about the axis of rotation. More specifically, for example, the upper section is operable when energized to rotate the drive shaft in a clockwise direction and the lower section is operable when energized to rotate the drive shaft in a counterclockwise direction of rotation. At the time one of the sections is energized to rotate the drive shaft in a given direction of rotation, the other section is deenergized to permit such rotation.

A diverting assembly 50 is mounted on the double acting solenoid 40 of each work station 13. Each diverting assembly has an upper arm 51 and a substantially parallel lower arm 52. The upper arm is mounted on the end of the upper portion 47 of the drive shaft 46 and the lower arm is mounted on the end of the lower portion 48 of the drive shaft. The upper and lower arms are interconnected by a vertical connecting arm 53 having a lower portion 54 with a leading edge 55.

Figure 2:
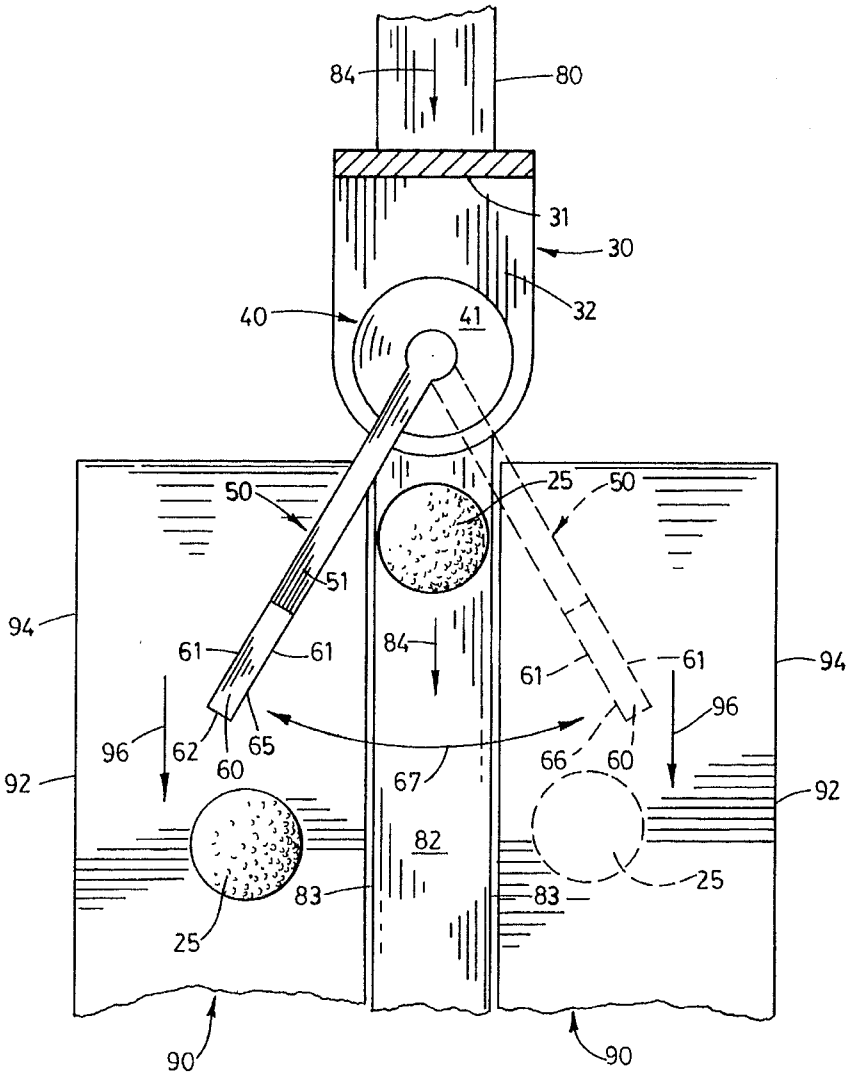
FIG. 2 is a somewhat enlarged, fragmentary horizontal section taken on line 2—2 in FIG. 1.

A diverting member 60 is mounted on the lower portion 54 of the vertical connecting arm 53 of each diverting assembly 50. The diverting member has substantially flat, opposite surfaces 61 and extends to a trailing edge 62 substantially parallel to the leading edge 55. The diverting member has a lower edge 63, substantially normal to the leading edge 55, and an opposite upper edge 64 substantially parallel to the lower edge. As shown in FIG. 2, each diverting member 60 is movable in an arc between a left position 65, shown in full lines in FIG. 2, and a right position 66, shown in phantom lines in FIG. 2. Arrow 67 indicates the arcuate path of travel of the diverting member 60.

Figure 3:
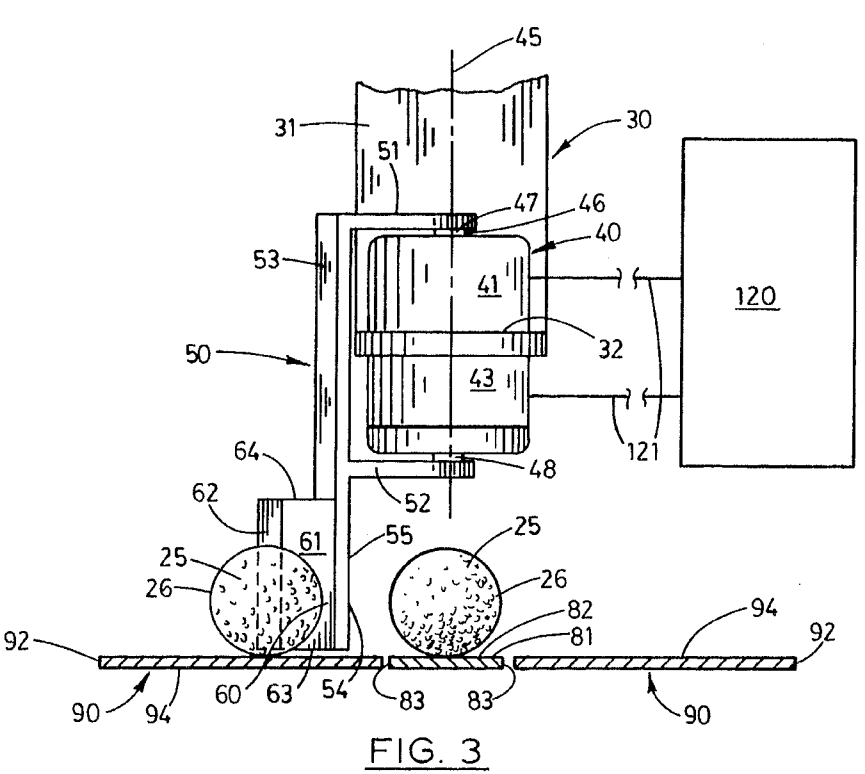
FIG. 3 is a somewhat enlarged, fragmentary transverse vertical section taken on line 3—3 in FIG. 1 and diagrammatically showing a sensing mechanism operably connected thereto.

The apparatus 10 has a central or main conveyor 80 mounted in the sorting machine 11 and shown fragmentarily in FIGS. 1, 2 and 3. The main conveyor is mounted for movement in any suitable fashion, not shown. The main conveyor has an upper run 81 which has an upper surface 82. The upper run has lateral edges 83 and is driven for movement in the direction indicated by arrows 84. If desired, particularly where indicated by the type of work object being transported, the upper surface 82 can be formed in a slightly concave configuration to help retain the work objects thereon prior to displacement therefrom and in accordance with the method and apparatus of the present invention.

The apparatus 10 has a pair of lateral, or receiving, conveyors 90 mounted on the sorting machine 11 extending from positions within each work station to positions forwardly thereof relative to the direction of travel of the main conveyor indicated by arrows 84, as can best be seen in FIG. 1. The receiving conveyors of each work station are disposed in adjacent spaced relation to the main conveyor on opposite sides thereof and in substantially side by side relation as can be seen best in FIG. 3. Each receiving conveyor is entrained about suitable rollers 91 and has an upper run 92 and a lower run 93. The upper run of each receiving conveyor has a receiving section 94, which is substantially horizontal, and a discharge section 95, which extends downwardly therefrom at an angle. The upper run of each receiving conveyor is driven, by any suitable means not shown, in the direction indicated by arrows 96.

The discharge sections 95 of the upper runs 92 of each pair of receiving conveyors 90 are disposed in work object discharging relation to a transverse conveyor 105. Each transverse conveyor is entrained about suitable rollers, not shown, and has an upper run 106 and a lower run 107. The upper run of each transverse conveyor has opposite lateral edges 108 and the upper run is driven in the direction indicated by arrow 109. It will be understood that the transverse conveyors feed to any desired collection point, such as another machine adapted to receive the work objects and to pack them in accordance with a predetermined plan of operation.

The apparatus 10, as previously discussed, operates in response to the sensing of predetermined characteristics of the work objects 25. As also previously discussed, any suitable mechanism for such sensing can be employed for this purpose including, for example, that of the applicant's U.S. Pat. No. 4,549,272. Such a sensing mechanism is shown diagrammatically at 120 in FIG. 3 operatively connected to the double acting solenoid 40 by electrical conductors 121. It will be understood that the sensing mechanism is operatively connected through the electrical conductors to each of the double acting solenoids for control thereof.

OPERATION

The operation of the method and apparatus of the present invention is believed to be readily apparent and is briefly summarized at this point. The apparatus 10 is operated in such a fashion as to receive work objects on the upper surface 82 of the upper run 81 of the main conveyor 80. As shown for illustrative convenience in the drawings, where the work objects are oranges, they may be spaced in increments in single file on the upper surface so as to provide spaces therebetween as shown in FIG. 1. However, the apparatus of the present invention is operable to perform the functions hereinafter described even where the work objects are positioned on the upper run of the main conveyor in much more closely spaced or even abutted relation in such single file.

The upper run 81 of the main conveyor is driven in the direction indicated by arrows 84. Similarly, the upper runs 92 of the receiving conveyors 90 are driven in the directions indicated by arrows 96. Still further, the upper runs 106 of the transverse conveyors 105 are driven in the directions indicated by arrows 109. Thus, the work objects are transported on the upper run of the main conveyor shown in FIG. 1. The sensing mechanism 120 senses the predetermined characteristics of the work objects as they are passed in such continuous movement. Each work station 13 is assigned to displace only work objects of selected predetermined configurations.

When a work object 25 of predetermined characteristics for a specific assigned work station is detected by the sensing mechanism 120, and with appropriate tinning achieved by any suitable mechanism, not shown, the double acting solenoid 40 of that work station is energized to cause the diverting assembly 50 to be moved in the path of travel indicated by arrows 67 from one of the positions 65 or 66 to the opposite position 65 or 66. This causes the diverting member 60 to be brought into contact with the work object and to displace the work object from the upper surface 82 of the main conveyor 80 to the upper run 92 of the receiving conveyor 90 beneath the position to which the diverting member is moved.

Referring more particularly to the operation of the double acting solenoid 40 in such an operation, it will be understood that such movement of the diverting assembly 50 is achieved by actuation of the double acting solenoid. For purposes of illustration, it will be understood that the upper section 41 when energized is operable to rotate the drive shaft 46 in a clockwise direction of rotation, as viewed in FIG. 2 and is deactivated to permit rotation of the drive shaft in a counterclockwise direction of rotation as viewed therein. Thus, in the illustrative example, the lower section 43 of the double acting solenoid is deactivated to permit rotation of the drive shaft in a clockwise direction of rotation, as viewed in FIG. 2, and is activated to drive the drive shaft in a counterclockwise direction of rotation as viewed in FIG. 2. In the illustrative example if the diverting assembly 50 is in the right position 66 shown in phantom lines in FIG. 2 and the double acting solenoid is actuated to move it to the left position 65 shown in full lines in FIG. 2, it is the upper section 41 of the double acting solenoid which drives the diverting assembly in this clockwise direction of movement. When movement of the diverting assembly is to be from the left position to the right position, it is the lower section 43 which drives the diverting assembly in this counterclockwise direction of movement.

In the illustrative example, when the diverting assembly 50 is moved from the right position 66, shown in phantom lines in FIG. 2, to the left position 65 shown in full lines in FIG. 2, a work object on the upper run 82 of the main conveyor 80 is moved therefrom onto the upper run 92 of the receiving conveyor 90 on the left as viewed in FIG. 2.

As noted, the reverse of the aforementioned example is also the case. In other words, if the diverting assembly 50 is in the left position 65 and is to be moved to the right position 66, as viewed in FIG. 2, in the illustrative example, the lower section 43 of the double acting solenoid 40 is driven in its counterclockwise direction to move the diverting assembly from the left position to the right position.

When the diverting assembly 50 has been moved to the left position 65 or right position 66, unlike all conventional devices, the diverting member is retained in that position. In other words, it is not returned to a start position in order to be ready again for the displacement of a successive work object from the main conveyor. This means that it is immediately available for use in displacing even the next successive work object from the main conveyor. Since the receiving conveyors 90 are on opposite sides of the main conveyor and since they feed the same transverse conveyor 105, it does not matter to which side of the main conveyor the work object is moved. Thus, unlike all prior art devices, the method and apparatus of the present invention are always immediately ready for the displacement of a work object from the main conveyor regardless of how closely spaced the work objects are on the conveyor and regardless whether or not an immediately successive work object possesses the predetermined characteristics requiring displacement at the same work station. As can best be visualized upon reference to FIG. 2, when a work object 25 is diverted from the main conveyor 80 to either of the receiving conveyors 90, the forward momentum of the work object by the main conveyor and, thereafter, by the receiving conveyor causes the work object, in effect, to move ahead of the trailing edge 62 of the diverting member 60 relative to its direction of travel. As a consequence, the work object always ends up "down stream" from the diverting member relative to the work object's direction of movement as shown in FIG. 2.

Therefore, the method and apparatus of the present invention are operable to achieve the precise and dependable displacement of work objects in accordance with predetermined characteristics efficiently, dependably and without the multitude of problems associated with conventional methods and apparatuses.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A method for selectively directing work objects, comprising passing said work objects along a primary path of travel; individually sensing predetermined characteristics of said work objects; and individually selectively diverting said work objects from said primary path of travel at predetermined locations in accordance with said predetermined characteristics of the work objects sensed in said sensing step to alternate sides of said primary path of travel without returning to a start position prior to diverting each successive work object, wherein said diverting includes contacting successive adjacent work objects passing along said primary path of travel, having said predetermined characteristics for diverting at said predetermined locations, in successive swaths of movement in substantially opposite directions across said primary path of travel to divert said successive adjacent work objects to opposite sides of said primary path of travel and wherein said contacting of said successive adjacent work objects is achieved by moving a work object contact member in a first direction to divert a first of said work objects to a first side of said primary path of travel and subsequently by moving said work object contact member in a second direction substantially opposite to said first direction to divert a second of said work objects to a second side of said primary path of travel substantially opposite to said first side of the primary path of travel; and collecting said work objects diverted from said path of travel to said first and second sides thereof for delivery to a common destination by establishing substantially continuous secondary paths of travel substantially parallel to and on opposite sides of said primary path of travel disposed individually to receive work objects diverted from said primary path of travel and by establishing a substantially continuous tertiary path of travel beneath said primary path of travel and substantially transversely related thereto in receiving relation to said secondary paths of travel to receive said work objects from the secondary paths of travel for delivery to a common collection point.

2. An apparatus for selectively directing work objects comprising a conveyor operable to transport a plurality of work objects thereon successively through a work station; means for detecting predetermined characteristics of said work objects as they are transported on the conveyor through said work station; and means operably connected to said detecting means in said work station operable to divert each work object passing through the work station, having said predetermined characteristics, from the conveyor in a first direction of movement and subsequently to divert the next successive work object so detected in a second direction of movement and wherein said second direction of movement is substantially opposite to the direction of said first direction of movement, said diverting means includes a diverting member mounted above said conveyor for movement in said first and second directions of movement without movement in a return direction after movement in either of said first or second directions of movement and said diverting means further includes a solenoid, mounted above the work object transport conveyor, a drive shaft having a pair of oppositely extending drive end portions and said drive shaft selectively driven in opposite directions and said diverting member is borne by a diverting assembly mounted on the drive shaft of the solenoid and the detecting means is operably connected in actuating relation to said solenoid for movement of the diverting member in said first and second directions of movement.

3. The apparatus of claim 2 wherein there are a plurality of said work stations located along the work object transport conveyor each having one of said solenoids, diverting assemblies and diverting members assembled and operable as in respect to the first of said work stations and said detecting means is individually operably connected in actuating relation to the solenoids thereof for individual operation thereof to divert work objects from the work object transport conveyor in said work stations having different predetermined characteristics.

* * * * *

UNITED STATES PATENT AND TRADEMARK OFFICE

CERTIFICATE OF CORRECTION

PATENT NO. : 5,469,974

DATED : November 28, 1995

INVENTOR(S) : James C. Hagan

It is certified that error appears in the above-identified patent and that said Letters Patent is hereby corrected as shown below:

Column 3, line 12, delete "frown" and substitute ---from---.

Column 3, line 21, delete "frown" and substitute ---from---.

Column 6, line 20, delete "tinning" and substitute ---timing---.

Signed and Sealed this

Nineteenth Day of March, 1996

Bruce Lehman

*Attest:*

BRUCE LEHMAN

*Attesting Officer*

*Commissioner of Patents and Trademarks*